US007621691B2

(12) United States Patent
Hannah

(10) Patent No.: US 7,621,691 B2
(45) Date of Patent: Nov. 24, 2009

(54) RAISED, LONGITUDINAL, CHANNELIZING SEPARATOR SYSTEM

(75) Inventor: Gregory L. Hannah, San Antonio, TX (US)

(73) Assignee: Impact Recovery Systems, Inc., San Antonio, TX (US)

( * ) Notice: Subject to any disclaimer, the term of this patent is extended or adjusted under 35 U.S.C. 154(b) by 0 days.

(21) Appl. No.: 11/891,709

(22) Filed: Aug. 13, 2007

(65) Prior Publication Data

US 2009/0047067 A1 Feb. 19, 2009

(51) Int. Cl.
*E01F 9/03* (2006.01)

(52) U.S. Cl. ..... 404/7; 404/9; 40/606.01

(58) Field of Classification Search ..... 404/6, 404/9, 7, 10, 15; 40/606.01, 612
See application file for complete search history.

(56) References Cited

U.S. PATENT DOCUMENTS

| | | | | | |
|---|---|---|---|---|---|
| 2,064,519 | A | * | 12/1936 | Casey et al. | 404/6 |
| 3,040,636 | A | * | 6/1962 | Simm et al. | 404/15 |
| 4,269,534 | A | * | 5/1981 | Ryan | 404/10 |
| 4,376,594 | A | | 3/1983 | Prosenz | |
| 4,515,499 | A | * | 5/1985 | Furiate | 404/6 |
| 4,596,489 | A | * | 6/1986 | Mariol et al. | 404/10 |
| 4,681,302 | A | * | 7/1987 | Thompson | 256/13.1 |
| 4,697,294 | A | * | 10/1987 | Schafer | 14/69.5 |
| 4,958,954 | A | * | 9/1990 | Schmanski et al. | 404/10 |
| 5,006,010 | A | * | 4/1991 | Duckett | 404/12 |
| 5,028,463 | A | * | 7/1991 | Cahill et al. | 428/35.7 |
| 5,137,391 | A | * | 8/1992 | Ballesteros | 404/6 |
| 5,181,695 | A | * | 1/1993 | Arthur | 256/13.1 |
| 5,208,585 | A | | 5/1993 | Sprague | |
| 5,375,941 | A | * | 12/1994 | Strobl, Jr. | 404/7 |
| 5,527,127 | A | * | 6/1996 | Junker | 404/6 |
| 5,620,277 | A | * | 4/1997 | Cole et al. | 404/10 |
| 5,836,714 | A | * | 11/1998 | Christensen | 404/6 |
| 5,882,140 | A | | 3/1999 | Yodock, Jr. et al. | |
| 5,938,370 | A | * | 8/1999 | Gzybowski | 404/6 |
| 6,036,400 | A | | 3/2000 | Clark | |
| 6,416,248 | B1 | | 7/2002 | Clark | |
| 6,616,369 | B2 | | 9/2003 | Clark | |
| 6,623,206 | B1 | * | 9/2003 | Blair et al. | 404/16 |
| 6,913,415 | B1 | | 7/2005 | Tagg | |
| 6,951,434 | B2 | | 10/2005 | Yodock, Jr. et al. | |
| 7,025,526 | B2 | | 4/2006 | Blair | |
| 7,168,881 | B2 | | 1/2007 | Hartlauer | |
| 7,234,275 | B1 | * | 6/2007 | Haggy et al. | 52/71 |
| 7,325,999 | B1 | * | 2/2008 | Schindler et al. | 404/10 |
| 2007/0116514 | A1 | * | 5/2007 | Woytowich et al. | 404/7 |
| 2007/0237579 | A1 | * | 10/2007 | Moscovitch | 404/15 |
| 2008/0131201 | A1 | * | 6/2008 | Audet | 404/10 |

* cited by examiner

*Primary Examiner*—Gary S Hartmann
(74) *Attorney, Agent, or Firm*—Jackson Walker, LLP

(57) ABSTRACT

A longitudinal, channelizing traffic separator system has interlocking D-shaped curb sections with a recessed delineator post mounting receptacle formed in the top side of interlocked sections at an interlock joint. The receptacle will releasably retain a quick-release delineator post. Tapered nose-end sections may be longitudinally aligned with interlocked curb modules at the beginning and end of a sequence of curb modules. The curb sections and nose-end sections have both longitudinal ribs and lateral plates beneath the top side to transmit top side loads to a support surface such as a roadway or bridge.

5 Claims, 7 Drawing Sheets

16
80
A
92
90
40
34
12
56
29
24
54
31
36
14
82
A

16
B
40
42
14
36
52
16
51
B

80
A
90
40
56
24
A 16
80
90
92
76
12
B
B
58
32
29
54
56
31
59
78
14
68
82

RAISED, LONGITUDINAL, CHANNELIZING SEPARATOR SYSTEM

BACKGROUND OF THE INVENTION

The present invention relates to highway traffic control barriers. More specifically, the invention relates to a raised, longitudinal, channelizing separator system having a quick release delineator mount. The system may be used for curves, medians, edge lines, work zones, rail crossings, toll booths, acceleration lanes, left turn lanes, thru lane protection, traffic calming applications, bike and pedestrian lanes, and anywhere the pavement markings are insufficient to provide safe channelization of traffic.

The system generally includes two interlockable curb halves, nose end sections, delineator mounting plate assemblies, and connection and mounting hardware.

Various types of systems exist to control and channelize highway traffic. Some systems are temporarily used in limited situations, such as during highway construction/repair or accident/emergency traffic redirection. Other systems are more permanent and may remain at an established location for years. Examples of such systems, which include portable and modular arrangements, are described in U.S. Pat. Nos. 4,083,033; 4,376,594; 5,208,585; 5,795,530; 5,882,140; 6,913,415; 6,951,434; 7,025,526; and 7,168,881.

Oftentimes the prior art systems include a combination of heavy barrels, concrete barriers, light flexible cones, and separate delineation signage posts including signage easels. The present system provides an improved modular design which directs road loads to the support surface rather than the mounting hardware. The system includes easy to assemble interlocking components, including a recessed, quick-release delineator mount for rapid interchange of delineators affixed to the curb or channelizer. Whether a temporary or permanent installation, traffic barriers and channelizers are often subject to impact and damage. The present inventive system allows for the curb or barrier portion of the system to be rigidly affixed to the support surface (highway, bridge, etc.) and the warning or direction delineator to be removably affixed to the curb or barrier.

An embodiment of the longitudinal channelized, raised separator system of the present invention utilizes an injection molded high-density polyethylene, mountable curb made of two halves, each half measuring approximately 12 inches wide by approximately 3½ inches tall (above the support surface) by approximately 20 inches long. Each raised curb section is provided with longitudinal ribs and lateral plates underneath to transfer loads directly to the road thereby eliminating stress on the mounting hardware. The curb sections interlock through a first tongue and grove sliding connection and are further connected by two approximate 7/16 inch×1½ inch bolts. The connected curb sections result in a modular, longitudinal length of approximately 40 inches. In an installation, the system provides a plurality of modular lengths of raised curbing which do not interconnect; each modular length is anchored independently.

Each half curb section has an anchor hole so that when interlocked, the sections may be anchored with two approximate ⅝ inch×5.0 inch lag bolts which are threaded into approximate ¾ inch×3½ inch plastic anchor sleeves placed in the highway or other support surface. Generally, the interlocked curb modules sections are spaced no less than ½ inch apart to form a continuous longitudinal appearance while allowing any road surface water to flow around and between the interlocked sections. Additionally, as appropriate, a separator system installation begins and ends with a tapering nose end section that measure approximately 12 inches wide×3½ inches tall×18 inches long at the curb abutment end and gradually tapers until it is approximately 1¾ inches tall at the traffic exposed end. Each nose end section may be anchored with three approximately ⅝ inch×5 inch lag bolts which are threaded into approximately ¾ inch×3½ inch plastic sleeves placed into the roadway or other supporting surface.

Traffic delineators, such as the type described in U.S. Pat. Nos. 4,806,046 and 5,199,814, having releasable bases as described in U.S. Pat. Nos. 6,036,400; 6,416,248; and 6,616,369, (which are fully incorporated herein by reference for all purposes) are removably attachable at the center of the interlocking curb halves in a recessed delineator mount receptacle by four, uprising mounting bolts. The recessed receptacle is formed by the interlocking of two curb halves creating a single circular receptacle. A generally circular base mounting plate is attached to the bottom of the formed receptacle and further connects the two curb halves. Appropriate delineators, with or without signage, may be quickly and easily affixed to or removed from the longitudinal separator by a simple twist of the delineator base to the curb mounting bolts.

BRIEF DESCRIPTION OF THE DRAWINGS

The present invention is described with reference to the accompanying drawings. In the drawings, like reference numbers indicate identical or functionally similar elements. In the drawings, which illustrate what are currently considered to be the best modes for carrying out the invention.

DETAILED DESCRIPTION OF THE PREFERRED EMBODIMENT

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1A:
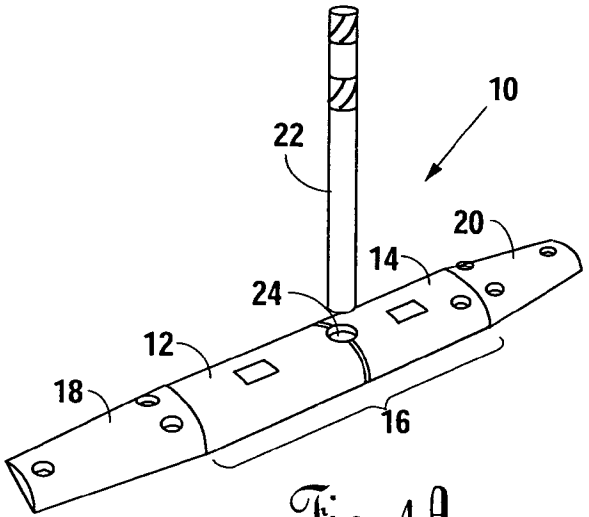
FIG. 1A is a perspective view of an embodiment of the present inventive system as an elongated, longitudinal channelizing separator with two nose-end sections, a channelizing module, and a releasably retained delineator post.

As generally illustrated in the Figures, the present invention provides a system for channelizing a portion of a roadway. FIG. 1A is a perspective view of an embodiment of the system 10, including two interlockable D-shaped curb halves 12, 14 interlocked to form an elongated, longitudinal, channelizing module 16; two D-shaped tapering, nose-end curb sections 18, 20; and a delineator post 22 releasably retained in a recessed delineator post mounting receptacle 24.

Figure 1B:
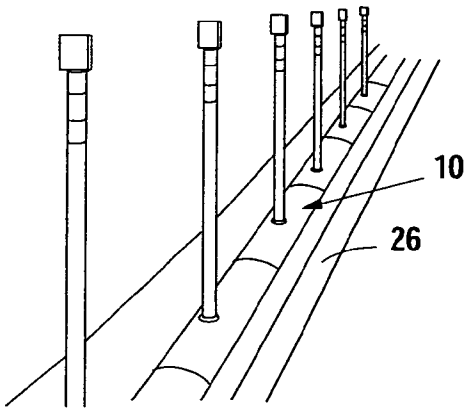
FIG. 1B illustrates an embodiment of the system in use on a roadway.
Figure 1C:
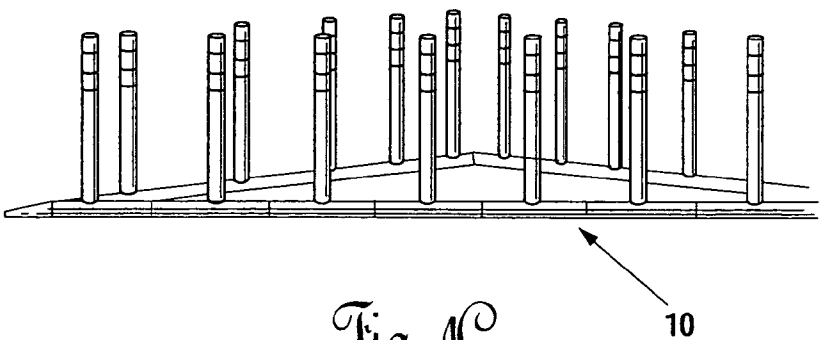
FIG. 1C shows an embodiment of the system in use as an arcuate turning island.
Figure 1D:
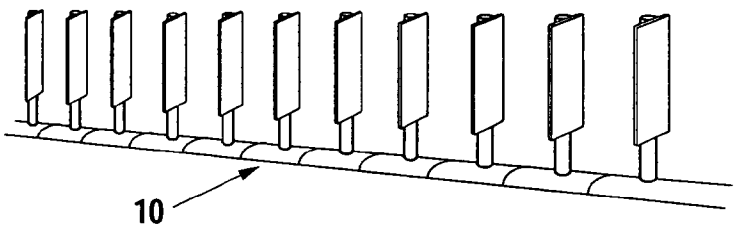
FIG. 1D shows an embodiment of the system in use as a straight medium.

The raised, longitudinal channelizing separator system 10 of the present invention is illustrated in use in FIGS. 1B-1D. FIG. 1B shows the system in place on a roadway 26 channelizing traffic along an off ramp. FIG. 1C illustrates the system forming an arcuate turning island. FIG. 1D shows how the system may be used to provide a generally straight median at an intersection.

Figures 2A, 2B:
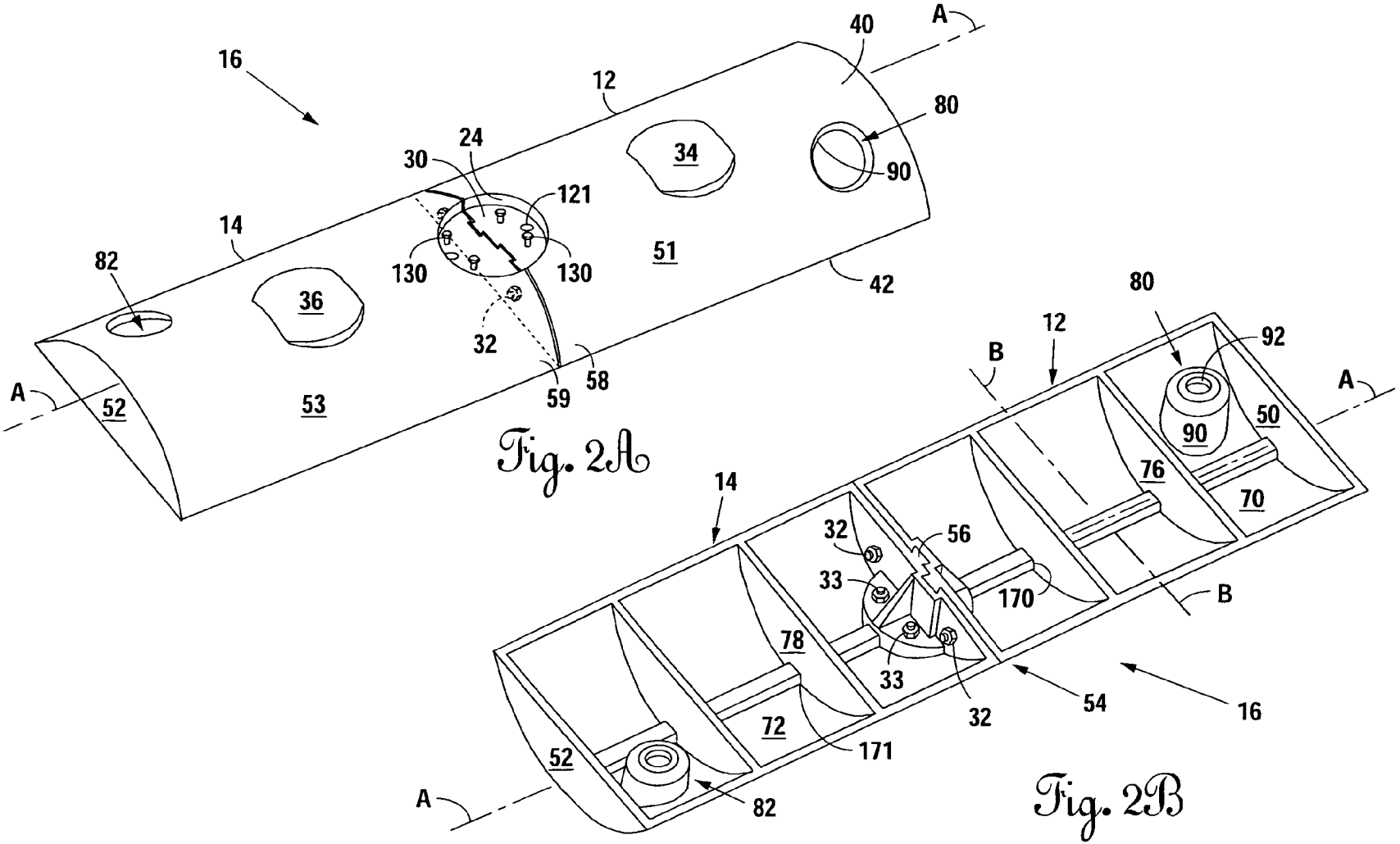
FIG. 2A is a top side perspective view of an embodiment of the system interlocked as a single channelizing module without nose-end sections.
FIG. 2B is a bottom side perspective view of an embodiment of the system of FIG. 2A.

Turning now to the detailed drawings of the present system, FIG. 2A illustrates a top side perspective of an elongated, interlocked longitudinal channelizing module 16 (approximately 12" wide×3½" high×40" long) comprised of two complementary D-shaped curb halves 12, 14; a circular mounting plate 30 attached in the bottom of the recessed delineator post mounting receptacle 24; connective fasteners 32; and raised, reflective pavement markers 34, 36 on each curb section. The sections 12, 14 are fabricated from injection molded, high-density polyethylene, but it should be understood that other equivalent compositions well-known in the art may be utilized. Each curb section is approximately 12" wide×3½" high×20" long.

Each curb section 12, 14 has a longitudinal axis A, a top side 40, and a bottom or underneath side 42. The top side 40 of the section is that portion of the curb facing away from a mounting surface, such as a roadway or bridge structure, and is molded in a generally semicircular shape yielding a D-shaped cross-sectional profile to the body portion 51, 53, as may be seen at the abutment ends 50, 52 of the curb sections in FIGS. 2A and 2B. Ends 50, 52 are referred to as "abutment ends," because each of these planar ends of the body portions 51, 53 of each curb section are designed to closely abut with complementary planar, abutment ends of additional modular sections or nose-end sections (FIGS. 8A-8C, 9A, 9B) at the beginning or ending of a particular installation as will be described below.

As indicated, a module 16 comprises two interlocked curb sections which may be clearly seen in FIG. 2B. FIG. 2B is a bottom or underneath perspective view of module 16 of FIG. 2A. Sections 12, 14 are interlocked at interlock joint 54 by a slidingly connectable complementary tongue and groove arrangement 56 as may be seen in detail in FIG. 5. Further fasteners 32 extend through holes 60 (FIGS. 6A, 6B, 7C) in the planar face 62 of the interlock ends 58, 59 of the curb sections. A circular mounting plate 30 (FIGS. 2A, 10A, 10B) supplies yet another means for securing sections 12, 14 together. The plate 30 is placed in receptacle 24 and secured by uprising bolts 130 and nuts 33. Thus, there are three complementary fastener systems to secure the engagement and connection of the curb sections to form the module 16.

Figure 4:
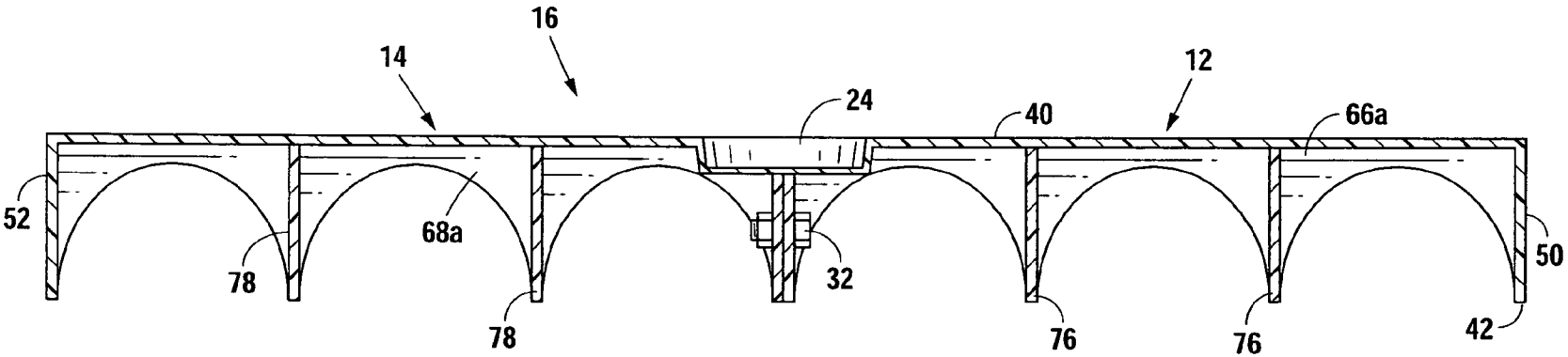
FIG. 4 is a longitudinal cross-sectional view of an embodiment with longitudinal arcuate truss ribs.

FIG. 2B exposes the generally hollow underneath construction of the interlockable curb sections. A longitudinal strengthening rib 66, 68 is provided along the underneath surface 70, 72 of each section. FIG. 2B illustrates an embodiment of wherein the longitudinal rib is a generally straight rigid beam. FIG. 4 illustrates an arcuate truss-like construction more adaptable to injection molding fabrication and which improves the transmission of top side loads to the support surface or structure rather than into the mounting and connective hardware.

Additionally support and road load transmission to the support surface is provided to each curb section by a plurality of semicircular plates 76, 78 extending parallel to a lateral axis B of the curb. Lateral axis B is generally perpendicular to longitudinal axis A. FIGS. 2A and 2B illustrate each lateral plate 76, 78 having a longitudinal rib notch 170, 171 to accommodate the longitudinal rib. Each curb section 12, 14 is further provided with an anchor hole 80, 82 through which lag bolts may extend and are threaded into plastic anchor sleeves placed in the highway or other support surface. The anchor hole is a cup-shaped indention 90 that extends from the top surface 40 of the section 12, 14 through to the bottom, underneath, open portion 42 of the curb section with the cup-like opening facing toward the top surface. Located at the bottom of the cup-shaped indentation is another through hole 92 for anchoring the section 12 to the support surface. The through hole is reasonably sized to receive mounting hardware. The opening of the cup-shaped indentation 90 is of a size complementary to the size of the through hole 92, i.e., large enough to receive a tool for use securing a lag bolt to the road via the through hole.

Figures 3A, 3B, 3C, 3D:
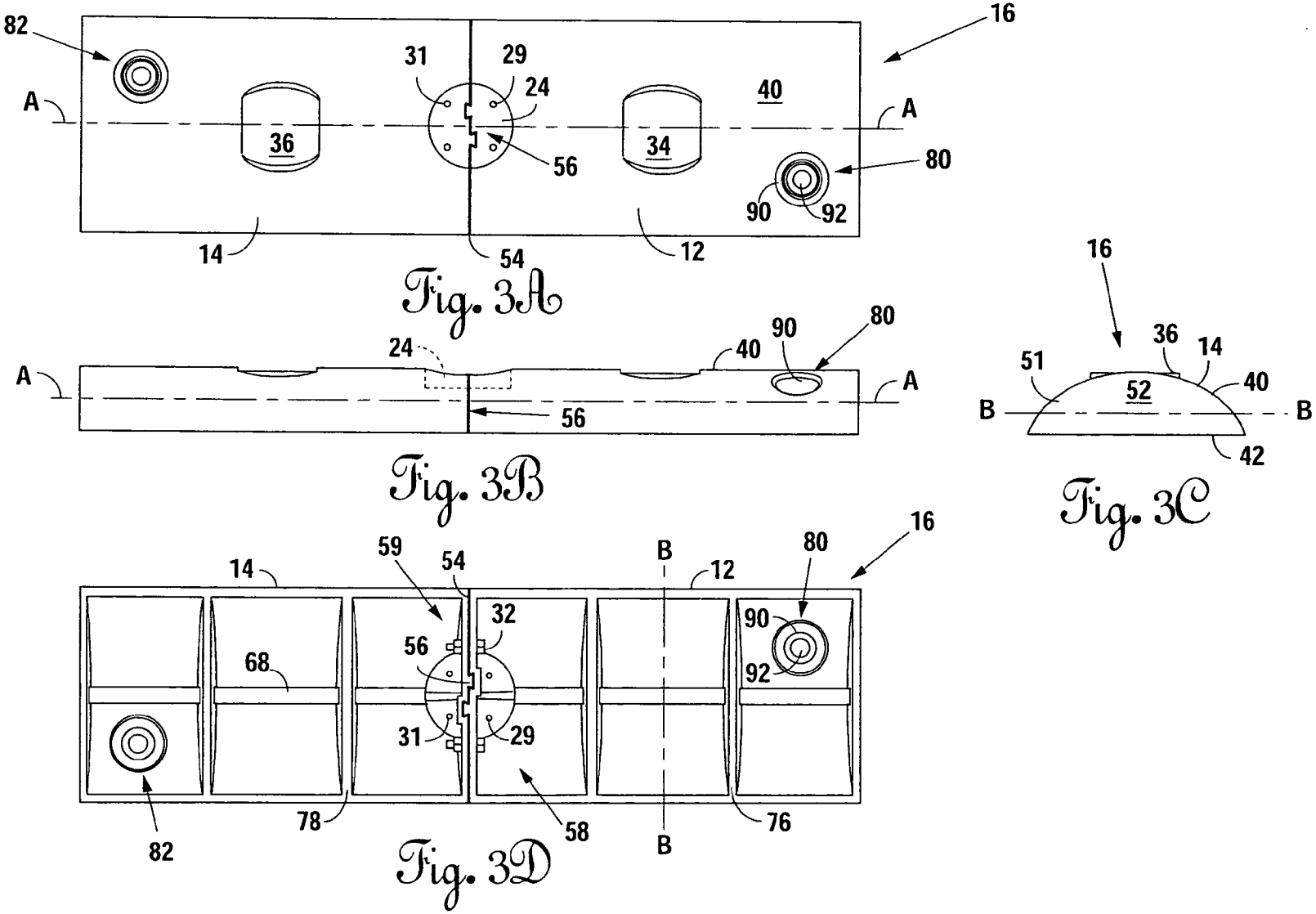
FIG. 3A illustrates a top plan view embodiment of the system without the mounting plate installed
FIG. 3B illustrates a side elevation plan view of the system of FIG. 3A
FIG. 3C shows an abutment end side view of the system of FIG. 3A.
FIG. 3*d* is a bottom plan view of the system of FIG. 3A.

FIGS. 3A-3D illustrate other views of the interlocked module 16 wherein the reference numbers designate the same or equivalent elements. A delineator mounting plate 30 is not shown as installed in FIGS. 3-3D, so that the tongue and groove interlock joint 54 and the fasteners 32 may be seen. The mounting holes 29, 31 provided in the curb halves for the mounting plate are shown in FIGS. 3A and 3D. The D-shape of the body portion 51 of one of the curb sections 14 is easily seen in FIG. 3C.

To provide high load strengths, structural members are provided as may be seen in FIG. 4, which is a longitudinal cross-sectional view of an alternate embodiment of the module 16. Module 16 in FIG. 4 is provided with arcuate, longitudinal ribs 66*a*, 68*a* beneath the topside 40 and extending between lateral, semicircular plates 76, 78. These truss-like ribs and lateral plates are integrally molded in the injection molding process and direct top side loads to the support surface to which the module is attached.

Figure 5:
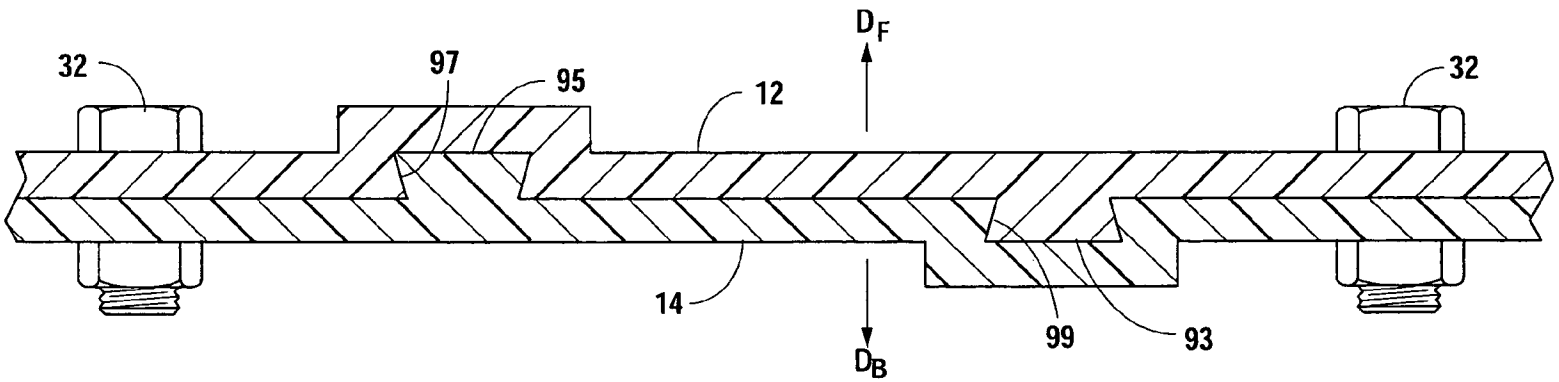
FIG. 5 is a partial cross-sectional view of the interlock joint of the system.

FIG. 5 illustrates a partial cross-sectional detail view of the slidingly connectable tongue and groove interlock system 56. Such an interlock is well-known for connecting two workpieces and is most frequently seen in the furniture construction art. It is employed in the present system to ensure a positive alignment of curb sections 12, 14 and a close interlocking fit. The tongue 95, 93 once slid into groove 97, 99 from the top side is restricted by its flared side walls from disengaging when traffic impact forces tend to urge the sections 12, 14 apart in the longitudinal directions of $D_F$ and $D_B$. The fasteners 32 provide additional strength to maintain the engagement and interlock of the sections 12, 14.

Figure 6A:
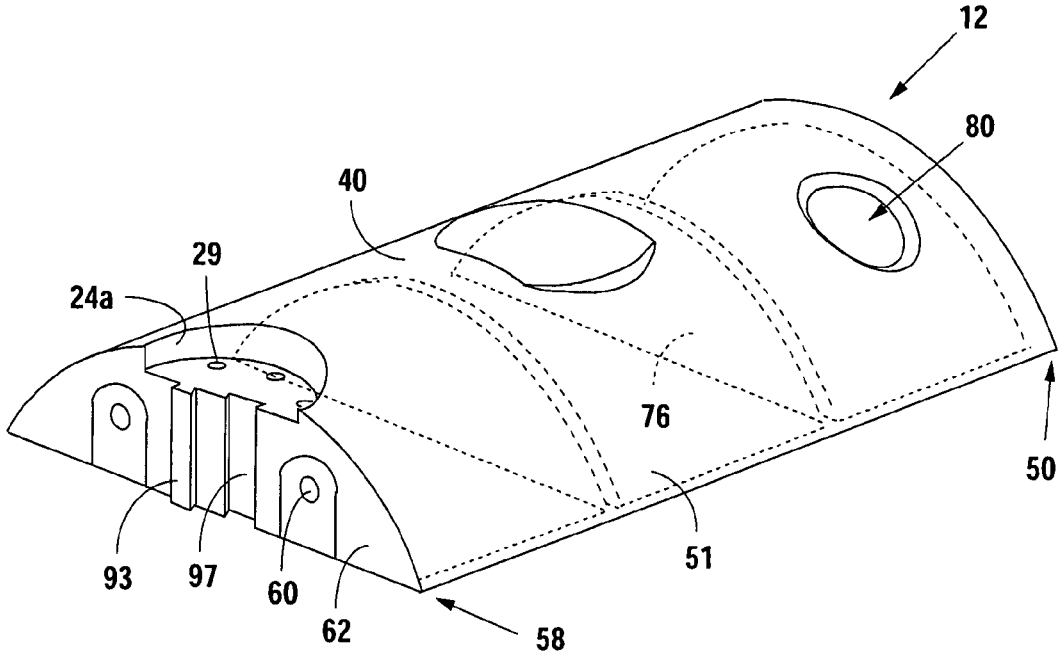
FIG. 6A is a top, interlock end perspective view of one of the interlockable curb sections of the present invention.
Figure 6B:
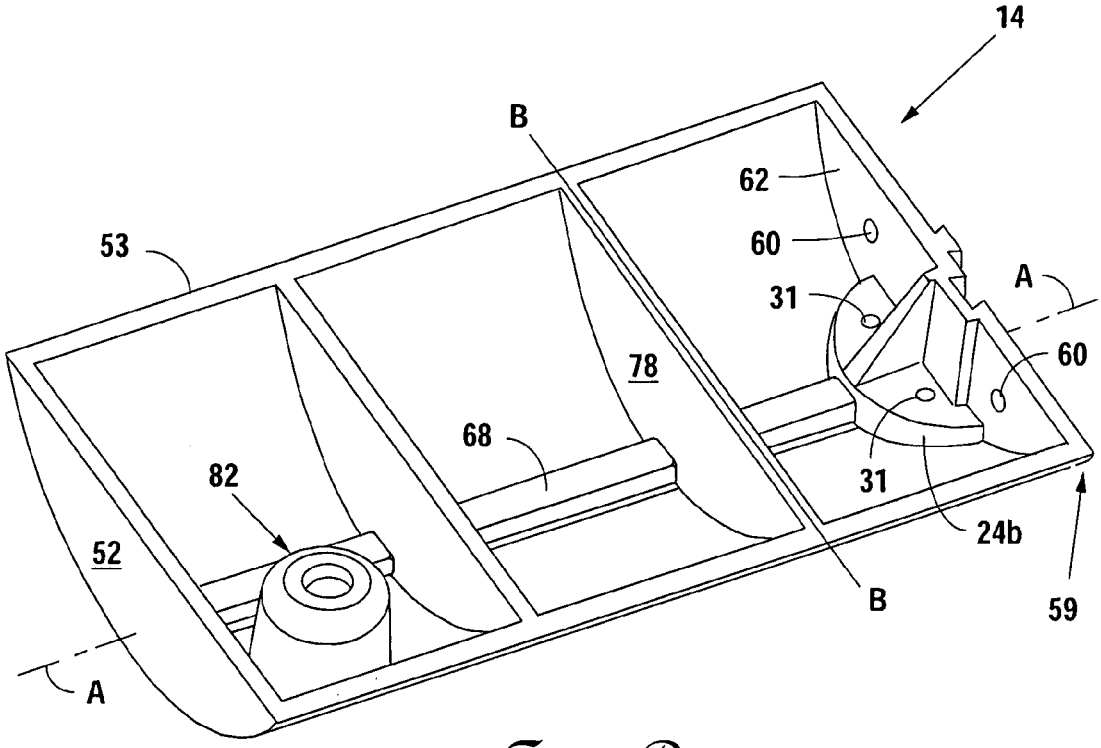
FIG. 6B is a bottom, abutment end perspective view of one of the interlockable curb sections of the present invention

FIGS. 6A and 6B provide perspective illustrations of the individual interlockable curb sections 12, 14. It should be noted that each section has a D-shaped body portion 51, 53 having a longitudinal axis A extending from an interlock end 58, 59 to an abutment end 50, 52. Each section has one-half of the circular recessed delineator post mounting receptacle 24*a*, 24*b*, which combines to form the circular recess 24 when the curb sections are cooperatively interlocked.

Figure 7A:
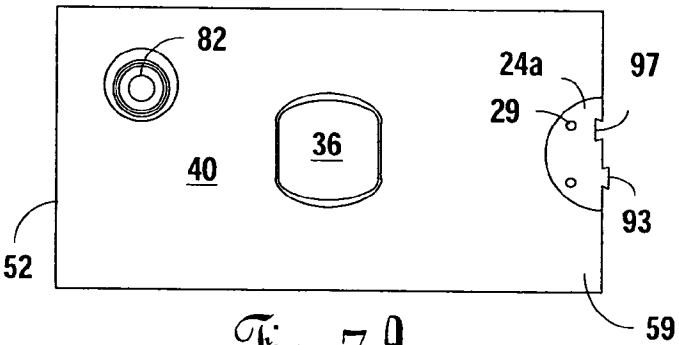
FIG. 7A illustrates a top plan view of one of the interlockable curb sections of the present system.
Figure 7B:
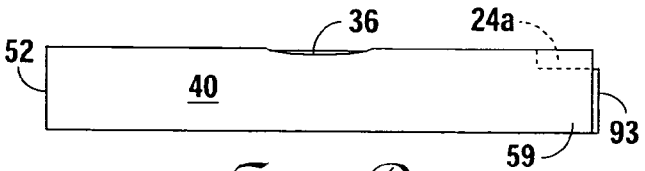
FIG. 7B is a side elevation view of the curb section of FIG. 7A.
Figure 7C:
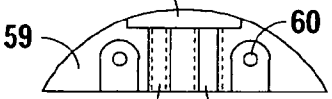
FIG. 7C is an interlock end elevation view of the curb section of FIG. 7A.

FIGS. 7A-7C illustrate top, side elevation, and end views of one of the curb sections 14 with reference numbers to the same of equivalent elements illustrated in the Figures.

A separator system installation of the present invention (FIG. 1A) usually begins and ends with a tapering nose-end section 18, 20. There may be several modules 16 between the beginning nose-end section and the ending nose-end section. Generally, the modules 16 are spaced not less than ½ inch apart to allow surface water and debris to flow around and between the modules while providing a continuous longitudinal appearance.

FIGS. 8A-8C and 9A, 9B illustrate a nose-end section 18 whether a beginning or end section. Each section 18 measures approximately 12 inches wide×3½ inches tall at the curb abutment end×18 inches long and gradually tapers to approximately 1¾ inches tall at the traffic exposed end 102.

Each nose-end section 18 has a D-shaped body portion 104 having a longitudinal axis AA extending from the curb abutment end 100 to the opposite traffic exposed end 102. In an installation, there is no interlocking connection between the nose-end section 18, 20 and the module; they are spaced apart no less than ½ inch with the longitudinal axis AA in longitudinal alignment with longitudinal axis A of one of the interlocked curb sections of the module 16. This may be seen in FIG. 1A.

Because the nose-end sections are exposed to the greatest likelihood of impact on a highway installation, each section 18, 20 is provided with three anchor holes 105, 107, 109. The construction of each anchor hole is similar to that described above for the anchor holes in the curb section 12, 14. Each nose end section anchor hole has a cup-shaped indention 110 and a through hole 112. Each D-shaped nose-end section is injection molded of high-density polyethylene composition or the like and provided with longitudinal ribs or an arcuate truss 114 extending between semicircular lateral plates 116 as similarly described with each curb section.

Figure 10A:
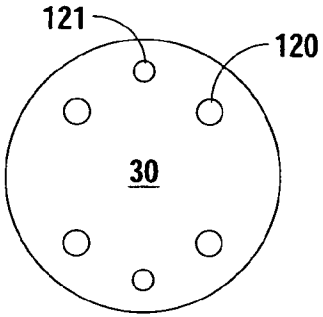
FIG. 10A is a top plan view of the circular mounting plate of the present system
Figure 10B:
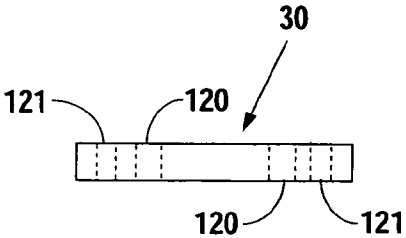
FIG. 10B is a side elevation view of the plate of FIG. 10A.
Figure 8B:
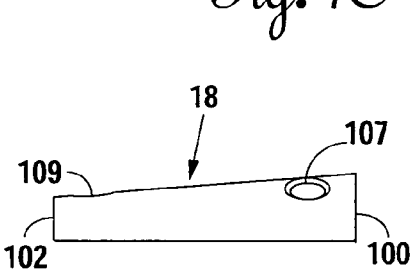
FIG. 8B is a side elevation view of the nose-end section of FIG. 8A.
Figure 8C:
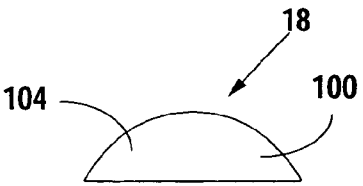
FIG. 8C is an abutment end elevation view of the nose-end section of FIG. 8A.
Figure 8A:
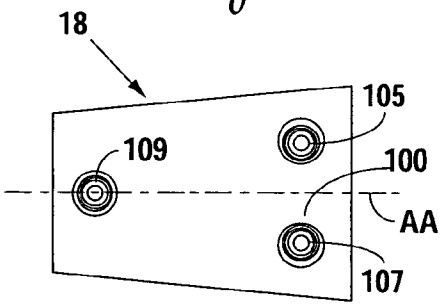
FIG. 8A shows a top plan view of one of the tapering nose-end sections of the present system.
Figure 9A:
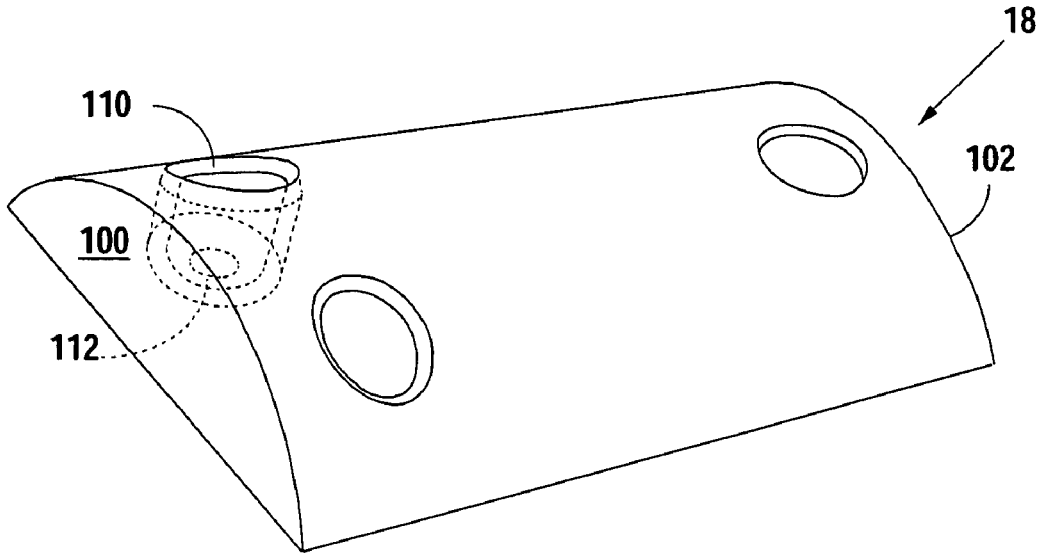
FIG. 9A is a top, abutment end perspective view of one of the tapering nose-end sections of the present system
Figure 9B:
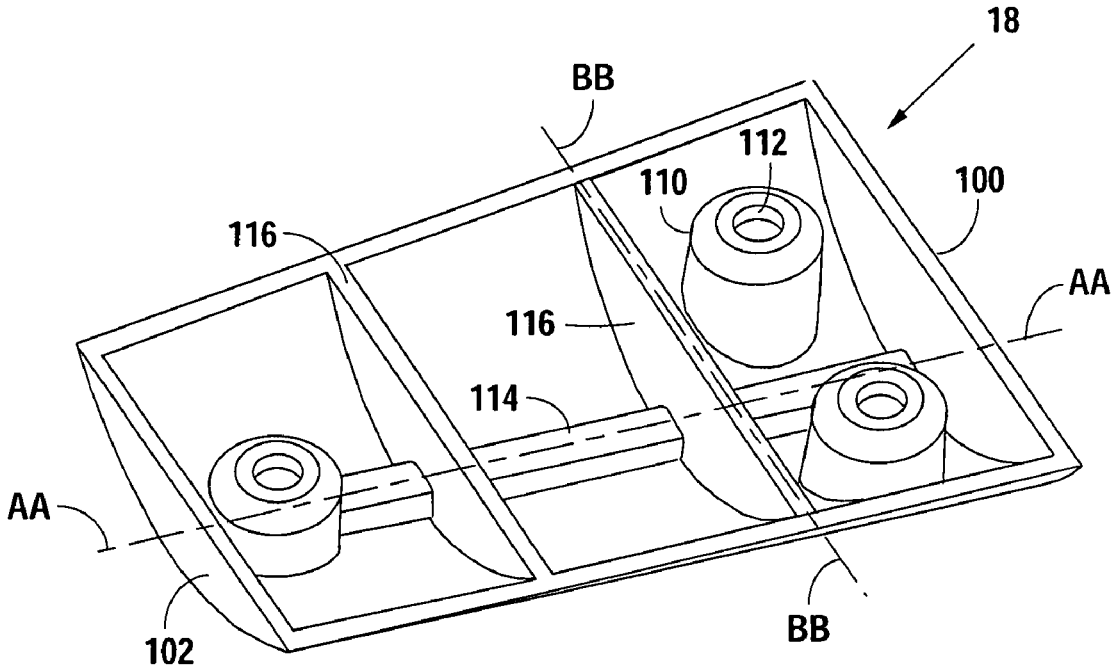
FIG. 9B is a bottom, exposed end perspective view of the nose-end section of FIG. 9A.

In an installation, typically a delineator post 22 (FIG. 1A) having a releasable base is removably attached at the recessed mounting receptacle 24 in the top side 40 of an interlocked module at the interlock joint 54. A mounting plate 30 as shown in FIGS. 10A and 10B is inserted into the circular receptacle 24 and uprising mounting bolts 130 with appropriate heads are extended through the plate holes 120 and through the mounting holes 29, 31 in the curb sections and retained by locking nuts 33. Plate 30 further is provided with quick-release pin detent holes 121. Such an arrangement of holes, bolts, and detents is fully described in U.S. Pat. Nos. 6,036,400; 6,416,248; and 6,616,369, which are incorporated herein by reference for all purposes.

It will be noted that when plate 30 is affixed to the bottom of receptacle 24 and fastened by nuts 33 (FIG. 2B), a third means for securing the interlock of the curb sections is provided. The uprising bolt heads enable the user to quickly attach and release a delineator post to the module.

Installation of the system is a very easy operation. An installer first reviews the detailed traffic engineering plan regarding length, angle, spacing, location, and all related placements for the longitudinal, channelizing separator system of the instant invention. Then the installer draws a string line tight approximately 6" off the centerline of the curb using the string as a guide to lay the module 16 (each module being equal to two interlockable curb sections 12, 14) in place and the installer then follows laying a second, third, fourth module, etc., with desired spacing. It is desired that the spacing between modules is no less than ½ inch apart, and no more than 1 inch for visual consideration. However, if drainage or other considerations warrant a greater spacing, the invention can still be installed.

Next, the installer drills, e.g., one ¾ inch hole 5 inches deep using one of the road attachment holes in the module as the template. The installer then cleans out the hole and uses lag bolts provided with a sleeve as an anchor to keep the module in position while drilling the second hole. The second hole is cleaned out and a sleeve is installed by placing a large washer on the lag bolt and starting the lag bolt in the sleeve by threading it in approximately ½ inch. The lag bolt and sleeve are punched through the hole in the module and into the previously drilled and cleaned pavement holes. The lag bolt is screwed into the pavement taking care not to over tighten. The installer then installs each module as described and in accordance with engineering plans.

Finally, tapered nose-end sections are installed on either end of the curb system and anchored as described for the separate modules. Each module is now adapted to receive a quick-release delineator system. To install an upright delineator into the module, the upright delineator is twisted into position where the quick-release pin will drop into position in the detent pin hole 121 and lock the delineator into place.

Although the invention has been described with reference to a certain embodiment, this description is not meant to be construed in a limiting sense. On the contrary, various modifications of the disclosed embodiment will become apparent to those skilled in the art upon reference to the description of the invention. It is therefore contemplated that the appended claims will cover such modifications, alternatives, and equivalents that fall within the true spirit and scope of the invention.

The invention claimed is:

1. A longitudinal, channelizing separator system comprising:

first and second interlockable curb sections, each said section comprising:

a D-shaped body portion having a longitudinal axis extending from an interlock end of said curb body portion to an abutment end of said curb body portion, each of said interlock ends of said curb body portion interlockable at an interlock joint by slidingly connectable complementary tongue and groove members and plurality of fasteners disposed adjacent said tongue and groove members and extending through planar faces of said interlock ends and parallel to said longitudinal axis;

a top side;

a bottom side;

a recessed delineator post mounting receptacle adapted in said top side at said interlock joint for releasably retaining a delineator base when said first and second interlockable curb sections are cooperatively interlocked;

an interlocking mounting plate disposed within said recessed receptacle at said interlock joint, said mounting plate covering said interlock joint above said tongue and groove members; and a second plurality of fasteners extending perpendicular to said longitudinal axis through mounting holes in said mounting plate and said top side of each of said curb body portions to secure said first and second interlockable curb sections in an interlocked position.

2. The system of claim 1 further comprising:

a nose-end section having a D-shaped body portion having a longitudinal axis extending from a first curb abutment end to an opposite, tapering exposed end, said first curb abutment end spaced apart from said abutment end of one of said curb sections, said longitudinal axis of said nose-end section in longitudinal alignment with said longitudinal axis of said one of said curb sections.

3. The system of claim 1 further comprising:

a plurality of lateral support plates disposed beneath said top side and extending generally perpendicular to said longitudinal axis of each of said interlockable curb sections; and a longitudinal support member disposed between said plurality of lateral support plates and extending along said longitudinal axis of each of said interlockable curb sections.

4. The system of claim 3 wherein said longitudinal support member is an arcuate truss.

5. The system of claim 2 wherein each of said interlockable curb sections has at least one anchoring hole and each of said nose-end sections has three anchoring holes, said holes adapted to receive a support surface attachment mechanism.

* * * * *